US006095377A

United States Patent [19]

Sweeton et al.

[11] Patent Number: 6,095,377

[45] Date of Patent: Aug. 1, 2000

[54] LIQUID DISPENSING PUMP

[75] Inventors: Steve L. Sweeton; Joseph K. Dodd, both of Lee's Summit, Mo.

[73] Assignee: Calmar Inc., City of Industry, Calif.

[21] Appl. No.: 09/276,926

[22] Filed: Mar. 26, 1999

[51] Int. Cl.[7] ..... B67D 5/40

[52] U.S. Cl. ..... 222/383.1

[58] Field of Search ..... 222/321.1, 321.3, 222/383.1, 481.5

[56] References Cited

U.S. PATENT DOCUMENTS

| | | | |
|---|---|---|---|
| 4,747,523 | 5/1988 | Dobbs | 222/383.1 |
| 5,779,108 | 7/1998 | Barriac et al. | 222/383.1 |
| 5,794,822 | 8/1998 | Foster | 222/383.1 |
| 5,884,820 | 5/1988 | Thanisch et al. | 222/383.1 |

*Primary Examiner*—Joseph A. Kaufman

*Attorney, Agent, or Firm*—Watson Cole Grindle Watson, P.L.L.C.

[57] ABSTRACT

A manually actuated dispensing pump has a pump housing for mounting with a closure cap at an upper end of a container for fluent product, the housing having a pump cylinder open at its outer end to atmosphere and providing at its inner end area a pump chamber for a manually reciprocable piston having a resilient piston seal, the cylinder having in its lower area at least one vent port positioned outwardly of the chamber, the piston having a vent seal for closing communication between the open end of the cylinder and the vent port, the piston forming a sub-assembly with the housing upon insertion into the cylinder through the open outer end thereof, and one or more ramps or tapered ribs being provided adjacent the vent port for spacing the piston seal from an inner edge of the vent port permitting the piston seal to by-pass the vent port to avoid any damage of the piston seal upon assembly into the cylinder.

10 Claims, 2 Drawing Sheets

LIQUID DISPENSING PUMP

BACKGROUND OF THE INVENTION

This invention relates generally to a trigger actuated pump dispenser having a pump piston reciprocable within a pump cylinder, the piston having an inboard piston seal and an outboard vent seal. The inner end of the cylinder provides a pump chamber, and the cylinder has in its lower region a vent port positioned outwardly of the pump chamber and in open communication with the interior of the container to which the dispenser is mounted. The vent seal closes communication between the open end of the cylinder and the atmosphere, and the vent seal is positioned outwardly of the vent port in all operative positions of the pump piston. Means at the inner surface of the cylinder permits the passage to by-pass the vent seal from the open end of the cylinder to the vent port during an inward pumping stroke of the piston.

Since the piston seal (sometimes referred to as a power chevron) and the vent seal (or vent chevron) straddle the vent port in all operative positions to the pump piston, the piston when first assembled into the bore must have its piston seal traverse the vent port. During this assembly process the piston seal oftentimes becomes scored as it slides across the inner edge of the vent port. Such damage, even if minor, is known to affect the tight sealability between the piston seal and the wall of the pump cylinder. This break in the seal causes unwanted leakage of product from the pump chamber which is under pressure during the piston power strokes. Such pressurized liquid thus blows by the piston seal and into the annular vent chamber formed between the piston seal and the vent seal. And during the inward pumping stroke of the piston that blow-by fluid escapes from the pump chamber back into the container via the vent chamber and vent port. On the ensuing return stroke, the damaged power chevron will admit unwanted air into the pump chamber via the vent chamber which is briefly opened to atmosphere. This reduces the ability of the pump to suction a sufficient amount of fluid into the pump chamber thus resulting in the pump chamber filled with a mixture of liquid and air. Continued pumping thus results in a poor spray pattern with sputtering of air and liquid through the nozzle orifice.

Also, if the power chevron is damaged during initial assembly, the number of strokes required to prime the pump increase and, depending on the extent of power chevron damage, may not prime at all.

Should damage to the power chevron be small such that the pump can be primed, then output during each piston stroke will be smaller than expected as liquid blows-by the power chevron and returns to the container via the vent chamber and vent port.

The piston seal may be in the form of a chevron seal which curves slightly inwardly at its inner peripheral edge, such that the outer wall surface of the chevron sealingly engages the confronting wall surface of the pump chamber. It is that outer surface which is oftentimes marred during piston assembly into its cylinder bore.

Otherwise the piston seal may be structured as having a sharp edge chevron seal such that the chevron engages the wall of the pump chamber at the outer peripheral edge thereof. This design facilitates a more complete scraping of the wall of the pump chamber during piston reciprocation for maintaining that wall surface completely free of any build-up of any undue film layer or of partly dried condensed particles of product. The pump chevron wipes the pump chamber wall clean during piston reciprocation so as to enhance the sealability between the pump seal and the pump chamber wall at all times.

This latter style pump chevron is even more prone to damage due to interference of its chevron while passing over the vent port during piston assembly. Since the peripheral edge of the chevron seal establishes the tight liquid seal with the pump chamber even minute scoring or marring of the chevron at that peripheral edge could break the tight seal with the pump chamber wall and thereby cause liquid blow-by.

SUMMARY OF THE INVENTION

It is therefore an object of the present invention to provide a manually actuated pump dispenser with its pump cylinder structured to avoid the aforenoted problems, in a simple and economical yet highly effective manner. The objective of the invention is carried out by the provision of means on the wall of the pump cylinder adjacent the vent port for spacing the piston seal from the inner edge of the vent port whereby the piston seal by-passes the vent port to avoid any abrasion of the piston seal upon insertion of the piston into the pump cylinder during the assembly process.

Such means for spacing the piston seal from the inner edge of the vent port on assembly of the piston comprises at least one tapered rib on one side of the vent port, although a pair of tapered ribs may be provided on opposite sides of the vent port if desired. In the case of two, side-by-side, vent ports a tapered rib may be provided to divide the two ports.

Other objects, advantages and novel features of the invention will become more apparent from the following detailed description of the invention when taken in conjunction with the accompanying drawings.

DETAILED DESCRIPTION OF THE INVENTION

Figure 1:
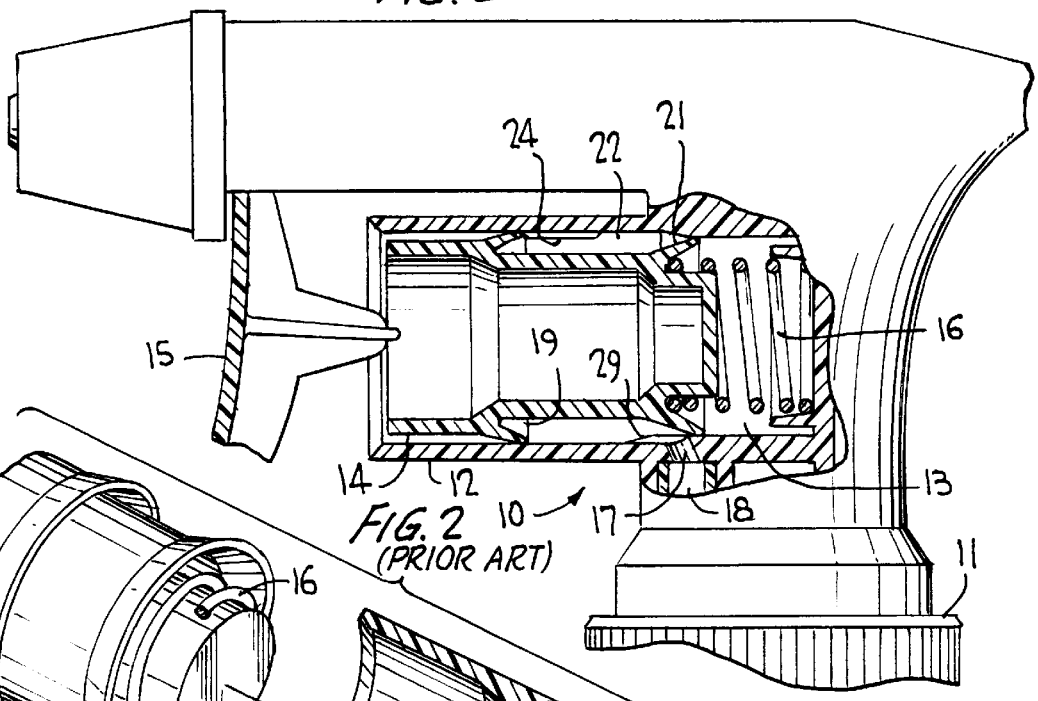
FIG. 1 is a side elevational view, partly broken away, of a trigger actuated pump dispenser incorporating the invention.

Turning now to the drawings wherein like reference characters refer to like and corresponding parts throughout the several views, FIG. 1 depicts a trigger actuated sprayer which includes a pump housing 10 having a closure member 11 to facilitate mounting the trigger sprayer to the neck of a container (not shown) of liquid product to be dispensed. The pump housing has a pump cylinder 12 open at its outer end to the atmosphere and providing at its inner end region a pump chamber 13 for a manually reciprocable pump piston 14. The piston is reciprocable inwardly and outwardly of the bore of its cylinder upon manual operation of trigger lever 15 hingedly mounted to the pump housing for shifting the piston inwardly during its pressure stroke. A piston return spring 16 resiliently urges the piston outwardly of its cylinder bore during its piston return stroke upon relaxation by the operator of force applied to the trigger lever.

Pump cylinder 12 has in its lower region a vent port 17 positioned outwardly of pump chamber 13 and in open communication with the interior of the container via a vent passage 18. The aforedescribed structural relationship is essentially disclosed in U.S. Pat. Nos. 4,618,077 and 5,114,049.

The piston has an annular vent seal 19, or chevron seal as it is sometimes called, for closing communication between the open end of the cylinder and the vent port. This piston likewise has an inboard piston seal 21, or chevron seal, spaced from the vent seal and defining therewith an annular vent chamber 22. Vent seal 19 is positioned outwardly of vent port 17 in all operative positions of the pump piston and sealingly engages the interior of pump chamber 13 in the outermost non-pumping position of the piston as shown in FIG. 1.

The cylinder comprises a counterbore 23 outwardly of the inner portion of the cylinder bore which defines the pump chamber, and vent seal 19 engages the interior of the counterbore. Counterbore 23 of the pump cylinder is formed in its inner surface with a longitudinal rib or ribs 24 to permit the passage of air past the vent seal from the open end of the cylinder to the vent port, during an inward, pumping stroke of the piston.

Figure 2:
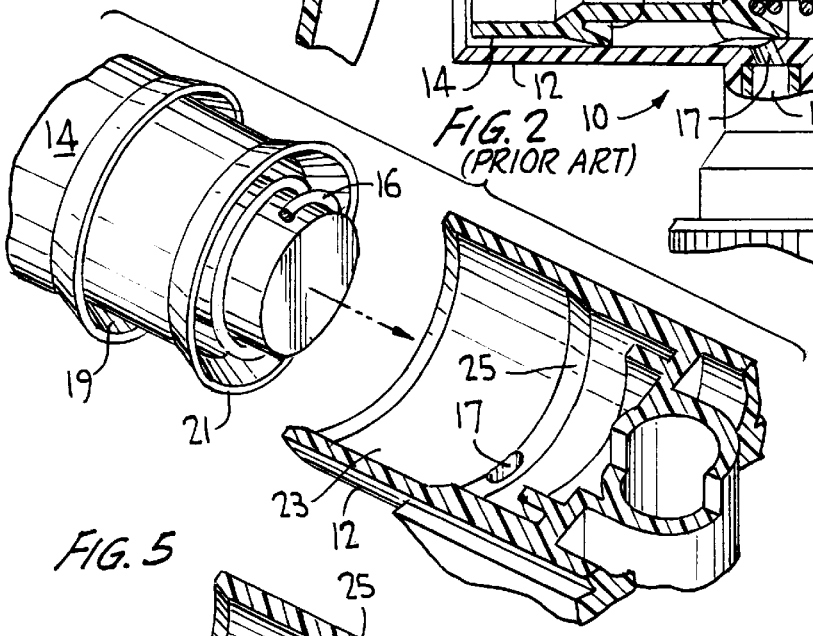
FIG. 2 (PRIOR ART)
FIG. 2 is a perspective view, partly broken away, of a composite of the pump piston and the pump cylinder of the prior art before the piston is inserted into the cylinder during assembly.
Figure 6:
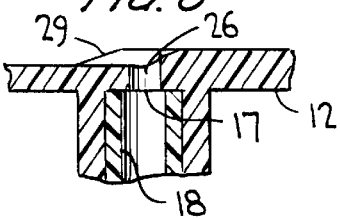
FIG. 6 is an enlarged sectional view taken substantially along the line 6—6, of FIG. 5.

As shown, vent port 17 is located in a transition area 25 between the bore and the counterbore, area 25 sloping gradually outwardly as shown. Upon initial insertion of the pump piston into its cylinder bore in the direction of the arrow of FIG. 2, piston seal 21 first slides along the counterbore and upon reaching transition area 25 is constricted about its periphery until it tightly and sealingly engages the wall of the cylinder bore which defines the pump chamber. During this process the piston seal traverses the vent port which at its inner end defines a sharp edge 26 (FIG. 6).

Figure 3:
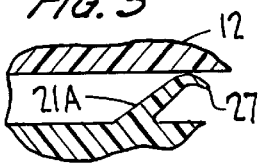
FIG. 3 is a sectional view showing part of one type of piston seal relative to its cylindrical bore.

The piston seal can be of the type shown in FIG. 3 at 21A in which its terminal end 27 does not engage the wall of the cylinder bore, but rather the end portion of the piston seal is curled inwardly such that contact is made with the cylinder bore by the outer curved surface of the piston seal, as shown. Thus during the assembly process this curved surface moves across edge 26 of the vent port and oftentimes becomes scored or marred during assembly. The piston seal when in its fully assembled position of FIG. 1 cannot therefore sealingly engage the wall of the cylinder bore with any degree of reliability because it has been damaged, even slightly, during the assembly process. This break compromises the tight sealing action required between the piston seal and the cylinder bore.

Figure 4:
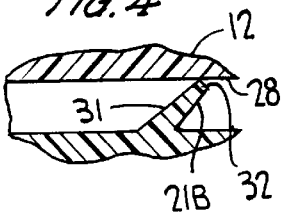
FIG. 4 is a view similar to FIG. 3 of another type of piston seal.
Figure 5:
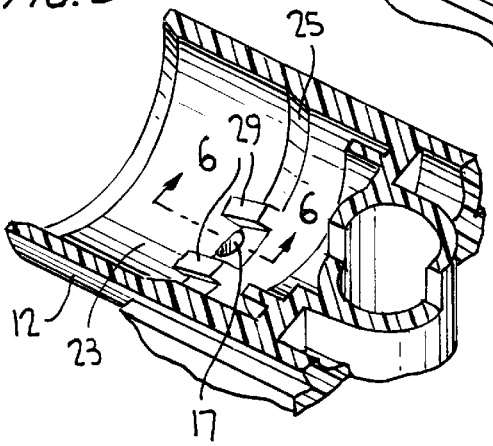
FIG. 5 is a view similar to FIG. 2 of the piston cylinder incorporating the present invention.

Another style of piston seal is shown in FIG. 4 at 21B in which the outer peripheral edge 28 of the seal engages the cylinder bore such that during the assembly process this peripheral edge is known to become damaged due to interference of the piston seal with inner edge 26 of the vent port. The peripheral edge is defined by the intersection of outer surface 31 and terminal end surface 32 of the lip seal. The piston seal is designed as having a sharp edge for wiping the surface of the cylinder bore clean during the piston strokes, thereby avoiding accumulation of any film or residue which would otherwise compromise the tight sealing action required between the piston seal and the cylinder bore.

Figure 7:
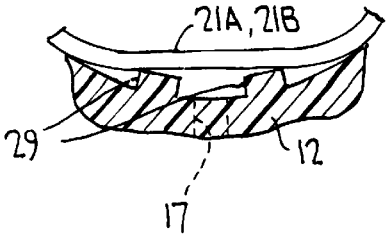
FIG. 7 is a cross-sectional view of the pump cylinder incorporating the invention, and of a part of the piston seal shown as avoiding contact with the vent port during assembly of the piston into its bore.

In accordance with the invention ramps 29 are provided at transition area 25 adjacent the vent port. If two ramps are provided they may be located on opposite sides of the vent port. If a single ramp is provided it may be located on one or the other side of the vent port in the nearby vicinity. The ramp or ramps are sloped as clearly shown in FIG. 6 for spacing piston seal 21A, 21B from inner sharp edge 26 of the vent port as the resilient piston seal 21 is temporarily distorted as shown in FIG. 7 during the process of forming a sub-assembly with the pump housing upon insertion of the pump piston into the cylinder through the open outer end thereof. When the piston seal reaches the pump cylinder bore of the cylinder it returns to its initial and undistorted condition and tightly engages the bore wall for sealing the liquid in the pump chamber against leakage.

Figure 8:
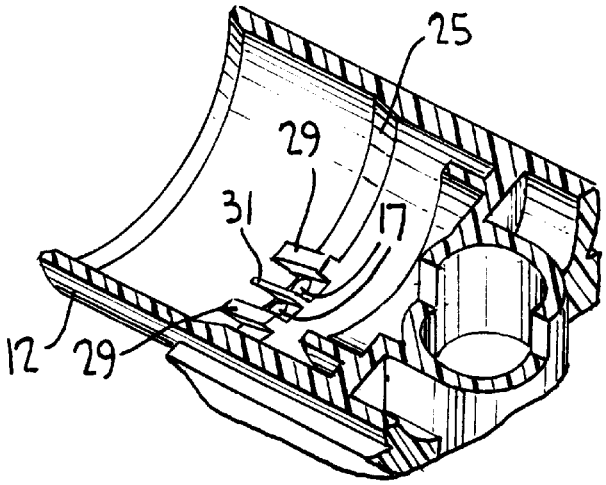
FIG. 8 is a view similar to FIG. 5 of another embodiment of the invention.

Should a pair of side-by-side vent ports 17 be provided in the sloping transition area 25 as shown in the FIG. 8 embodiment, sloping ramps 29 may be located on outer sides of the pair, and an intervening ramp 31 may be provided between the outer ramps to assure full clearance between power chevrons 21A, 21B and the inner edges of the vent ports upon assembly. Such an arrangement of ramps 29, 31 may likewise be provided for a single elongated vent port in lieu of the side-by-side pair shown.

Figure 9:
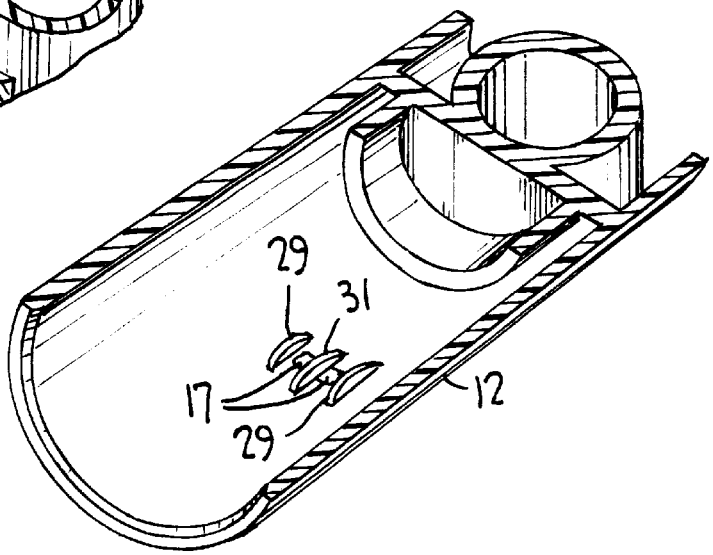
FIG. 9 is a view similar to FIG. 8 of yet another embodiment of the invention.

The invention is not limited to incorporation into a pump cylinder having a bore/counterbore in which the vent port or ports are located at a sloping transitional area. The cylinder may otherwise have a straight bore as shown in FIG. 9 with the vent port or ports 17 being located outwardly of pump cylinder 13 as in the FIG. 1 embodiment.

During the assembly process, the outer curved edge of piston seal 21A, or sharp edge 28 of piston seal 21B are lifted temporarily away from the vent port and its inner sharp edge so as to by-pass the vent port or ports thereby avoiding any abrasion or marring of the piston seal which could thereafter affect the sprayer performance. In accordance with the invention, the integrity of the piston seal is preserved after being assembled together with the pump housing, and the tendency for leakage from the pump chamber during pumping is minimized as the piston seal avoids abrasion due to interference with the vent port upon installation. Also, by preserving the integrity of the power chevron, the reliability of pump priming is enhanced, and the quality of spray during pumping is improved.

The provision of one or more tapered ribs or ramps on one or both sides of the vent port for temporarily lifting a portion of the vent seal away from transition area 15 during the assembly process to thereby space that peripheral portion of the piston seal away from the vent port and its inner sharp edge, avoids scoring or marring or some other form of abrasion due to scraping against that sharp edge as in the prior art. The ramps are simply molded in place during the pump housing molding process. The approach taken in accordance with the invention is solving the problems noted for the prior art sprayers is economical and uncomplicated yet highly effective.

Obviously many modifications and variations of the present invention are made possible in the light of the above teachings. It is therefore to be understood that within the scope of the appended claims the invention may be practiced otherwise than as specifically described.

What is claimed is:

1. A manually actuated dispensing pump, comprising a pump housing for mounting with a closure cap at an upper end of a container for fluent product, the housing comprising a pump cylinder open at its outer end to atmosphere and providing at its inner end area a pump chamber for a manually reciprocable piston having a resilient piston seal, said cylinder having in its lower area at least one vent port positioned outwardly of said chamber, said piston having a vent seal for closing communication between the open end of said cylinder and the vent port, said piston forming a sub-assembly with said housing upon insertion into said cylinder through said open outer end thereof, the improvement wherein said cylinder has on its inner surface means adjacent said vent port for spacing said piston seal from an inner edge of said vent port permitting the piston seal to by-pass said vent port to avoid any damage of said piston seal upon assembly into said cylinder.

2. The pump according to claim 1, wherein said cylinder comprises a counterbore outwardly of said pump chamber, said vent seal engaging the interior of the counterbore, a transition between said chamber and said counterbore defining an annular ramp, said vent port being located at said ramp.

3. The pump according to claim 1, wherein said vent seal comprises a flexible lip seal having a peripheral edge in sealing engagement with an inner surface of said pump chamber, said peripheral edge being defined by the intersection of outer and terminal end surfaces of said lip seal.

4. The pump according to claim 1, wherein said cylinder comprises a bore of substantially constant diameter.

5. The pump according to claim 1, wherein said spacing means comprises at least one tapered rib on one side of said vent port.

6. The pump according to claim 1, wherein said spacing means comprise a pair tapered ribs on opposite sides of said vent port.

7. The pump according to claim 2, wherein said spacing means comprises at least one tapered rib on said annular ramp at one side of said vent port.

8. The pump according to claim 2, wherein said spacing means comprise at least a pair of tapered ribs on said annular ramp at opposite sides of said vent port.

9. The pump according to claim 7, wherein said spacing means further comprise an intervening tapered rib on said annular ramp between said pair of ribs.

10. The pump according to claim 2, wherein a pair of side-by-side vent ports are provided at said ramp, said spacing means comprising a pair of tapered ribs and an intervening rib therebetween on said ramp in the immediate vicinity of said vent ports.

* * * * *